US005730323A

United States Patent [19]

Osborne

[11] Patent Number: 5,730,323

[45] Date of Patent: Mar. 24, 1998

[54] AUTOMATIC PRESSURE REGULATED LIQUID DISPENSING DEVICE

[75] Inventor: John O. Osborne, Kildeer, Ill.

[73] Assignee: Codell Industries, Inc., Las Vegas, Nev.

[21] Appl. No.: 681,326

[22] Filed: Jul. 22, 1996

[51] Int. Cl.[6] ..... B67D 5/08

[52] U.S. Cl. ..... 222/55; 222/129.1; 222/399; 222/504; 222/641

[58] Field of Search ..... 222/23, 39, 55, 222/61, 129.1, 504, 641, 399

[56] References Cited

U.S. PATENT DOCUMENTS

| | | | |
|---|---|---|---|
| 3,666,143 | 5/1972 | Weston | 222/61 |
| 5,072,853 | 12/1991 | Shannon | 222/55 |
| 5,277,333 | 1/1994 | Shimano | 222/55 |
| 5,454,406 | 10/1995 | Rejret et al. . | |

FOREIGN PATENT DOCUMENTS

| | | | |
|---|---|---|---|
| 2055348 | 3/1981 | United Kingdom . | |
| 2089767 | 6/1982 | United Kingdom . | |
| 2140389 | 11/1984 | United Kingdom | 222/641 |
| 2128166B | 2/1986 | United Kingdom . | |
| 2147274B | 12/1987 | United Kingdom . | |
| 2199806 | 7/1988 | United Kingdom . | |
| 2263687 | 8/1993 | United Kingdom . | |
| 2265357 | 9/1993 | United Kingdom . | |
| 2265357B | 1/1995 | United Kingdom . | |
| 2263687B | 2/1995 | United Kingdom . | |

*Primary Examiner*—Philippe Derakshani
*Attorney, Agent, or Firm*—Wood, Phillips, VanSanten, Clark & Mortimer

[57] ABSTRACT

An apparatus for controllably delivering a liquid under pressure from a supply to a first location is provided having a first structure operable for a predetermined first time interval to cause flow of a first predetermined quantity of liquid at a first pressure from the supply to the first location, and a second structure for sensing the pressure of the liquid and as an incident of sensing that the pressure of the liquid is not at the first pressure causing a compensating delivery of liquid from the supply to the first location so that the first predetermined quantity of liquid is delivered to the first location each time the first structure is operated for the first time interval. The first structure is capable of operating for a plurality of different time intervals corresponding to a plurality of different size containers selectable by a user to be filled.

21 Claims, 3 Drawing Sheets

AUTOMATIC PRESSURE REGULATED LIQUID DISPENSING DEVICE

BACKGROUND OF THE INVENTION

1. Technical Field

The present invention relates to a beverage dispensing apparatus for automatically filling a container of a particular size, and more particularly to an apparatus for compensating for a change in pressure in the beverage supply line to automatically cause consistent filling of a container of a particular size regardless of a change in pressure in the beverage supply line.

2. Background Art

The dispensing of a beverage (beer, pop, etc.) from a tap is well known in the art. Either a lever operated valve (as is normally the case with beer) or a push button valve (as is normally the case with pop) is operated by a server to fill a container (glass, pitcher, etc.) with the beverage. In both of the above examples, manual operation is required by the server.

Such manual operation requires the user to visually monitor the level of beverage in the container and manually close the valve when the container is filled to the desired level. As the container is being filled, the server may become distracted or may leave the dispensing apparatus to perform another task and attempt to return before the container is filled. Often times the result is that the beverage overflows from the container before the server shuts off the valve. Over time, the amount of beverage lost by overflow can create a considerable loss of money to an establishment that charges its patrons per pour. This is especially true if the establishment is a stadium, arena, etc., which sells large quantities of pop and beer.

In an attempt to reduce overflow, and thus save money, automatic beverage dispensers have been developed. The concept behind these prior art devices is that the server merely has to push a button and the proper amount of a beverage should be dispensed into the container from a pressurized supply. The server no longer has to visually monitor the flow of beverage into the container and can perform other tasks while the container is being filled, thus becoming more productive. One such prior art device is disclosed in U.S. Pat. No. 5,454,406, the description of which is incorporated herein.

In these prior art automated systems, a valve is automatically held open for a predetermined period of time to allow a particular size container to be filled with the beverage. As different size containers are selectively filled, the valve is correspondingly held open for different time intervals to allow the requisite amount of beverage to flow to the container. Dispensing a beverage in this manner assumes that the beverage will flow from the supply to the container at a relatively uniform flow rate each time a container is filled. However, as is known in the art, various factors can affect the flow rate of the beverage.

A change in the pressurization of the supply will cause either a larger or lesser amount of the beverage to flow to the container in a predetermined time interval. If more beverage is supplied than will fit into the container, overflow occurs and money is lost. If less beverage is supplied, the server will have to "top off" the container manually.

SUMMARY OF THE INVENTION

The present invention is specifically directed to overcoming the above enumerated problems in a novel and simple manner.

According to the invention, an apparatus for controllably delivering a liquid under pressure from a supply to a first location is provided having a first structure operable for a predetermined first time interval to cause flow of a first predetermined quantity of liquid at a first pressure from the supply to the first location, and a second structure for sensing a change in pressure of the liquid from the first pressure and causing a compensating delivery of liquid from the supply to the first location so that the first predetermined quantity of liquid is delivered to the first location.

In one form, the first structure includes a dispenser having a valve changeable between (a) a first state wherein liquid is allowed to flow from the supply to the first location and (b) a second state, a structure responsive to a first signal for changing the valve from the second state into the first state, a first control for producing the first signal in response to a user inputted command, and a user operable input for entering the command.

In one form, the second structure includes a device for producing a second signal indicative of the fact that the pressure of the liquid sensed by the second structure is one of (a) greater than and (b) less than the first pressure, and the valve includes a structure responsive to the second signal for controlling the state of the valve so that the first predetermined quantity of liquid is delivered to the first location each time the command is entered by the user.

In one form, the valve controlling structure causes the valve to be placed in the first state for a period of time longer than the first time interval if the pressure of the liquid sensed by the second structure is less than the first pressure by at least one of (a) maintaining the valve in the first state for an extra predetermined time interval and (b) switching the valve from the second state back to the first state for an extra predetermined time interval after the expiration of the first time interval.

In one form, the valve controlling structure causes the valve to be placed in the first state for a period of time shorter than the first time interval if the pressure of the liquid sensed by the second structure is greater than the first pressure by switching the valve to the second state before the expiration of the first time interval.

The dispenser may include an inlet port in fluid communication with the supply via a first line, an outlet port in fluid communication with the first location via a second line, and a flexible tube member connecting the inlet and outlet ports.

The second structure may include a pressure sensor operably connected to at least one of (a) the first line and (b) the second line.

The second signal producing device may include a second control for receiving a pressure signal generated by the pressure sensor and producing the second signal in response thereto.

In one form, with the valve in the first state liquid is allowed to flow from the supply to the first location through the flexible tube member, and with the valve in the second state the valve compresses the flexible tube member so that liquid is prevented from flowing from the supply to the first location through the flexible tube member.

In one form, the valve is a solenoid valve including an electrically operated solenoid having energized and deenergized states in response to the first and second signals, an armature extending from the solenoid, and a closure member attached to the armature.

In one form, the solenoid in the deenergized state forces the closure member against the flexible tube member to prevent the flow of liquid therethrough, and the solenoid in an energized state repositions the closure member relative to the flexible tube member to allow the flow of liquid therethrough.

In one form, the solenoid valve may include a compression spring forcing the closure member against the flexible tube member with the solenoid in the deenergized state.

In one form, the first structure may be operable for one of a plurality of predetermined different time intervals to cause flow of one of a plurality of predetermined different quantities of liquid at the first pressure from the supply to the first location, wherein during one predetermined time interval one predetermined quantity of liquid is allowed to flow from the supply to the first location.

In one form, the user operable input includes a control panel having a plurality of push button switches for selecting which of the plurality of predetermined quantities of liquid is to be delivered to the first location.

In one form, the apparatus is in combination with a pressurized supply.

An object of the present invention is to automatically regulate the dispensing of a beverage through an automatic dispenser to compensate for a change in pressure of the beverage supply line.

Other aspects, objects and advantages of the present invention can be obtained from a study of the specification, the drawings, and the appended claims.

DETAILED DESCRIPTION OF THE PREFERRED EMBODIMENTS

Figure 1:
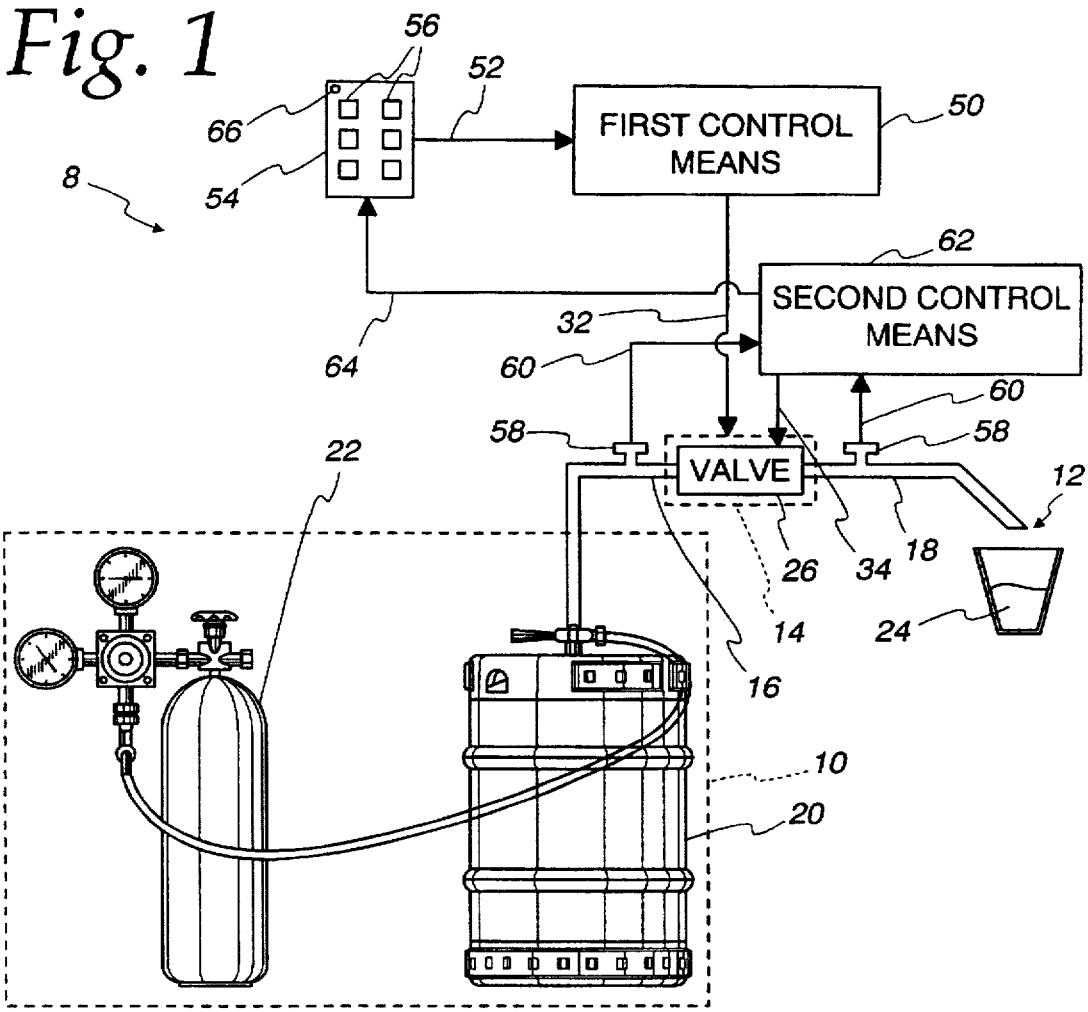
FIG. 1 is a schematic representation of a first embodiment of a liquid dispensing device according to the present invention.

With reference to FIG. 1, an automatic regulating/dispensing apparatus/system 8 is provided for delivering controlled amounts of liquid beverage from a pressurized supply 10 to an outlet/first location 12. A dispenser 14 is provided between the supply 10 and outlet/first location 12 and is in fluid communication with the supply 10 and outlet/first location 12 via first and second lines, 16,18, respectively. In an exemplary application, the supply 10 is a keg 20 of beer or a tank containing pop (not shown) and is pressurized by a tank 22 of gas, such as $CO_2$, to force the beverage from the supply 10 through first line 16, dispenser 14, and second line 18 to the outlet/first location 12, and accordingly into a suitable container 24 which is placed thereunder.

The dispenser 14 includes a valve 26 which is used to control the flow of beverage from the supply 10 to the outlet/first location 12. In a preferred form, the valve 26 is a solenoid valve 28 (shown more particularly in FIG. 5). However, one skilled in the art will recognize that many types of valves can be utilized with the present invention without departing from the spirit and scope thereof.

Figure 4:
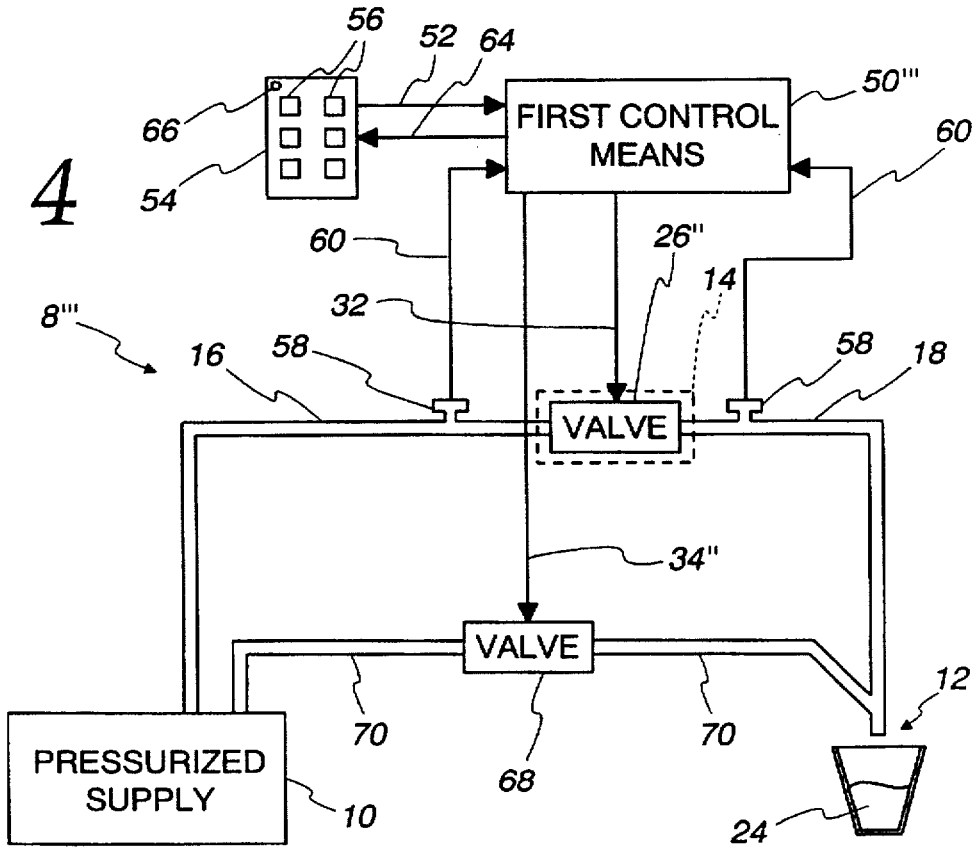
FIG. 4 is a schematic representation of a fourth embodiment of a liquid dispensing device according to the present invention.
Figure 5:
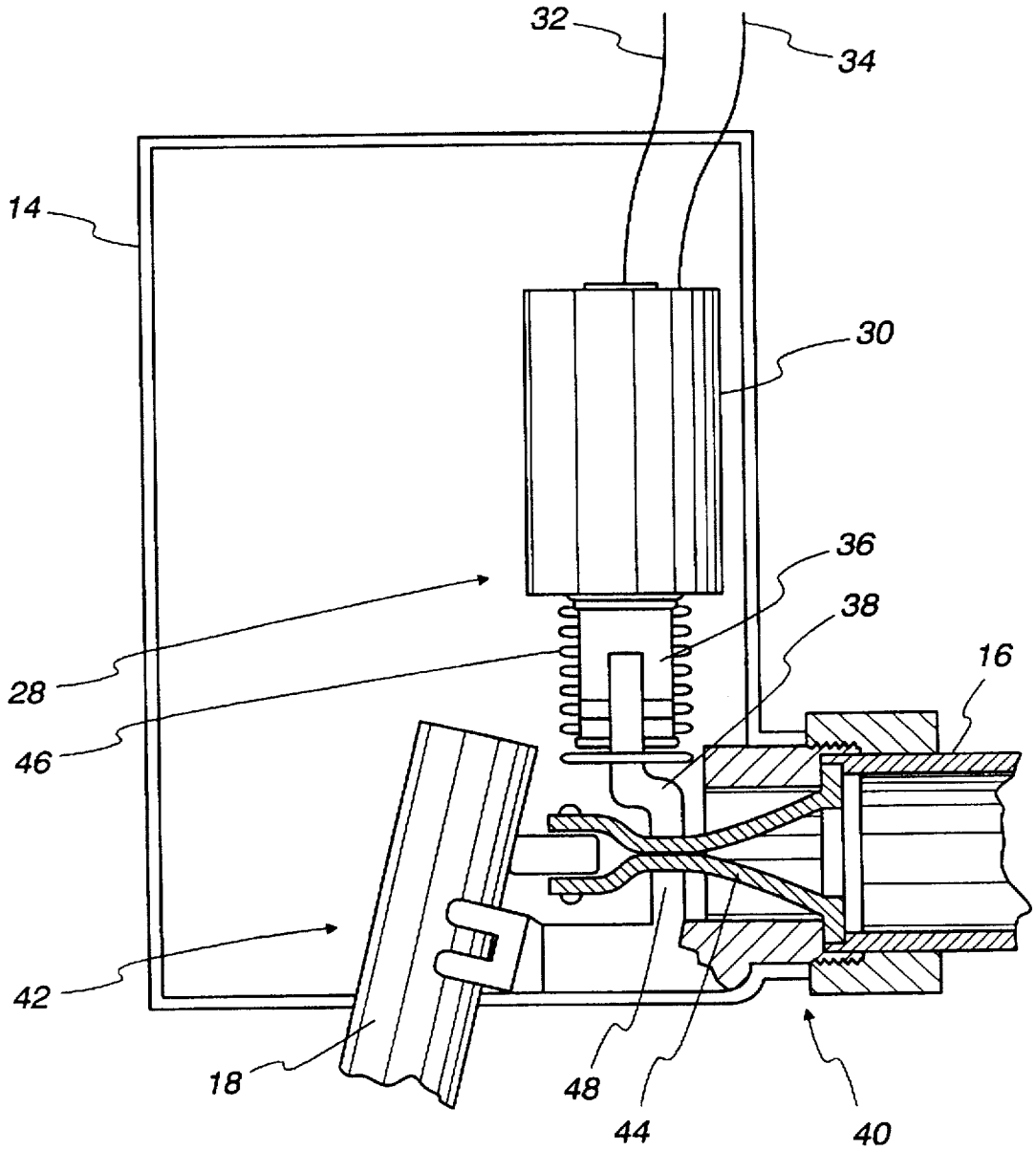
FIG. 5 is a cross-sectional view of a dispenser that can be incorporated into the inventive liquid dispensing device.

Referring now to FIG. 5, the solenoid valve 28 includes a solenoid 30, which is electrically operable between energized and deenergized states in response to first and second control signals, 32,34, the production of which will be described below. In the event two valves are incorporated into the present invention (see FIGS. 3 and 4), the valve need only be responsive to one of the control signals. An armature 36 is attached to the solenoid 30 and includes a pinch off member 38 attached to an external end of the armature 36. The solenoid valve 28 operates in a manner similar to the valve disclosed in U.S. Pat. No. 5,454,406.

The dispenser 14, shown generally in FIG. 5, includes input and output ports, 40,42, connected to the first and second lines, 16,18, respectively. The first line 16 allows fluid communication between the input port 40 and supply 10, while the second line 18 allows fluid communication between the output port 42 and outlet/first location 12. The input and output ports, 40,42 are internally connected in the dispenser 14 by a flexible tube 44. The connection of these elements is similar to that described in U.S. Pat. No. 5,454,406.

When the solenoid 30 is deenergized, a compression spring 46 forces the armature 36 downward, thereby forcing the pinch off member 38 against the flexible tube 44. This forces the flexible tube 44 against an anvil 48, thereby closing the interior passage of the flexible tube 44 and preventing the flow of beverage therethrough. When the solenoid 30 is energized, the armature 36, and therefore pinch off member 38, move upward, thereby releasing the flexible tube 44 and allowing a flow of beverage to pass through its interior passage. It is to be understood that other types of actuators, which can be operated in response to control signals, can be used to replace the solenoid 30 without departing from the spirit and scope of the present invention.

Referring back to FIG. 1, the system 8 includes a first control means 50 which receives an input signal 52 from a user operable input means 54. In response to receiving the input signal 52, the first control means 50 produces the first control signal 32, which is supplied to the valve 26 for operation thereof.

In a preferred form, the user input means 54 is similar to that described in U.S. Pat. No. 5,454,406, and may consist of a keypad or control panel including a plurality of membrane push button switches 56 which are operable by the server. The switches 56 allow the user to select which one of a plurality of different size beverage containers is to be filled.

In operation, the server places a container 24 underneath the outlet/first location 12 and presses a switch 56 corresponding to the size of the container 24 to be filled, thereby initiating automatic dispensing of the beverage from the supply 10. Other push button switches may be designated to perform other functions such as described in U.S. Pat. No. 5,454,406. These other functions may consist of, but are not limited to, adding small quantities of beverage to "top off" the container, and terminating a pour in progress.

The first control signal 32, which is produced by the first control means 50, is supplied to the valve 26 and causes the valve 26 to remain in an open position for a predetermined time interval corresponding to the size of the container 24 to be filled. The different time intervals, corresponding to the different size containers, are programmed in the first control means 50 and are initiated upon the first control means 50 receiving the input signal 52 indicating which of the different size containers 24 is to be filled.

The first control means 50 is similar to the control circuit described in U.S. Pat. No. 5,454,406, and is programmed in a similar manner. Namely, the first control means 50 generally consists of a microcomputer which includes a microprocessor, input/output ports, and memory and timer circuits (none of which have been shown). A read only memory for storing general operating programs and a random access memory for storing variables used during operation are provided in the microcomputer. However, the specific type of control circuit is not critical to the present invention and those skilled in the art will recognize that other types of control circuits may be utilized without departing from the spirit and scope of the present invention.

As previously noted, the different time intervals are programmed in the first control means 50 in a manner similar to that described in U.S. Pat. No. 5,454,406, and a detailed discussion is accordingly not necessary. Suffice it to say that after programming, a plurality of different time intervals will be stored in the first control means 50, each associated with one of the switches 56 to cause different quantities of beverage to be delivered from the supply 10 to outlet/first location 12 to fill different size containers 24. Since the beverage is to flow at a relatively uniform pressure, the larger the container 24 desired to be filled, the longer the time interval associated with filling that particular container 24 to a desired level.

Due to fluctuations in the pressure of the beverage, as well as various other factors, a preset volume of beverage may not be dispensed into the container 24 when the valve 26 is held in an open position for the corresponding predetermined period of time. The dispensed volume may be more or less than the preset volume depending upon whether the pressure of the beverage supply line fluctuates up or down from the original operating pressure. To compensate for this, a pressure sensor 58 is disposed either in the first or second lines, 16, 18.

In a preferred form, the pressure sensor 58 is a Fujikura Model XFPM-200KPGR integrated semiconductor pressure sensor. Model XFPM-200KPGR is a high level output, on-chip signal conditioned, temperature compensated and calibrated pressure transducer, which is normally utilized with non-corrosive gases and air. The pressure sensor 58 is responsive to a change in pressure of the beverage in the supply line and produces a pressure signal 60 directly related to the amount of pressure exerted on the sensor 58. The pressure signal 60 is supplied to a second control means 62, and depending upon the size of the container 24 which was selected by the user to be filled, and also the change in pressure of the beverage in the supply line from the original pressure (first pressure), the second control means 62 produces the second control signal 34 which is also supplied to the valve 26 to automatically provide a compensating delivery of beverage to the container 24 to ensure that the selected volume of beverage is delivered thereto.

In a preferred form, the second control means 62 is similar to the first control means 50, generally consisting of a microcomputer including a microprocessor, input/output ports, and read only and random access memories (none of which have been shown). Again however, the exact type of control circuit is not critical to the present invention and those skilled in the art will recognize that other types of control circuits may be employed without departing from the spirit and scope of the present invention.

Delivery compensation occurs according to the following. If the pressure of the beverage in the supply line sensed by the pressure sensor 58 is less than the original operating pressure, merely opening the valve 26 for the selected predetermined time interval will not supply enough beverage to fill the selected container 24 to the desired level. The pressure signal 60 is indicative of the fact that the sensed pressure of the beverage is less than the original pressure. In response to receiving the pressure signal 60, the second control means 62 produces the second control signal 34 which is supplied to the valve 26. The second control signal 34 will either maintain the valve 26 in its open position for an extra time period to allow a compensating delivery of liquid to flow from the supply 10 to the container 24, or will switch the valve 26 from the closed position back to the open position for a predetermined extra time period to allow a compensating delivery of liquid from the supply 10 to the container 24. In either case, the present invention automatically regulates the dispensing of the beverage so that the volume of beverage dispensed remains the same regardless of a change in pressure in the beverage supply line (first and second lines, 16, 18).

On the other hand, if the pressure of the beverage in the supply line sensed by the pressure sensor 58 is greater than the original operating pressure, the amount of beverage flowing from the supply 10 to the container 24 during the selected preset time interval will be greater than the amount needed to fill the container 24 to the desired level. As a result, overflow may occur. To compensate for this, the second control means 62, upon receiving the pressure signal 60 indicative of the fact that the sensed pressure is greater than the original operating pressure, produces the second control signal 34 which causes the valve 26 to close a predetermined time period before the expiration of the selected preset time interval. This results in the selected volume of beverage flowing from the supply 10 to the container 24.

The time intervals associated with the second control means 62 (either keeping valve 26 open longer than, or closing it before the expiration of, the selected preset time interval) are programmed in the second control means 62 and depend upon a combination of the original operating pressure, the amount of change in the sensed pressure from the original operating pressure, and the size of the container selected to be filled (i.e., the preset time interval for holding the valve 26 in an open position).

As an extra feature, the second control means 62 may be programmed to automatically close the valve 26 and/or produce a tank empty signal 64 which activates an indicating light 66 on the user input means 54 should the pressure of the beverage fall below a preset value. This would indicate to a user that the pressurized tank 22 of $CO_2$, or the like, needs to be replaced. While an indicating light 66 is provided as an example, any indicating means, either audio (such as a series of beeps) or visual, which would provide an indication to a user that the tank 22 is empty is contemplated by the present invention.

Figure 2:
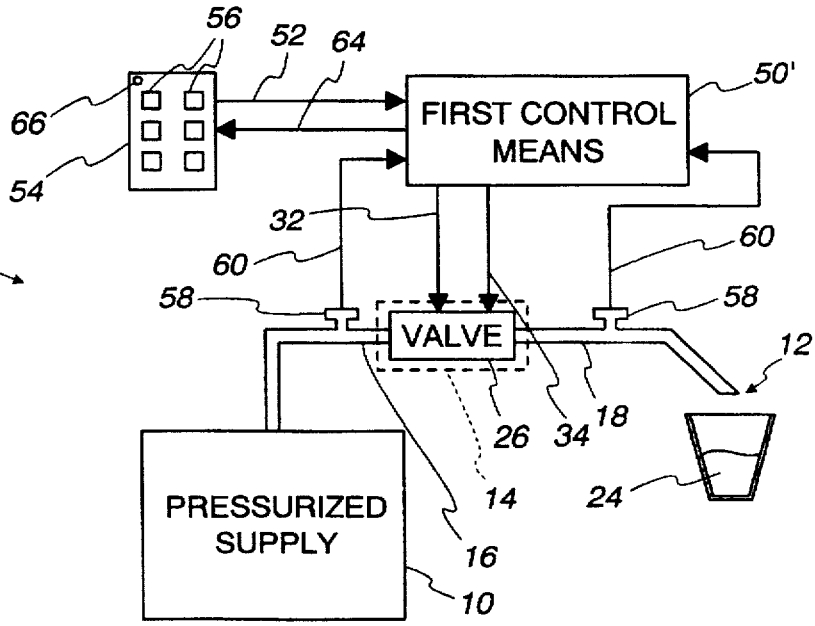
FIG. 2 is a schematic representation of a second embodiment of a liquid dispensing device according to the present invention.

With reference to FIG. 2, wherein like elements of FIG. 1 are designated with the same reference numbers and elements which have been modified are designated with a prime ('), an alternative embodiment of the regulating/dispensing apparatus/system 8' is provided. In this embodiment, the first control means 50' is adapted to receive the pressure signal 60 from the pressure sensor 58, and produces the second control signal 34 which is applied to the valve 26 to provide the compensating delivery of beverage in the manner as previously described with respect to FIG. 1.

Figure 3:
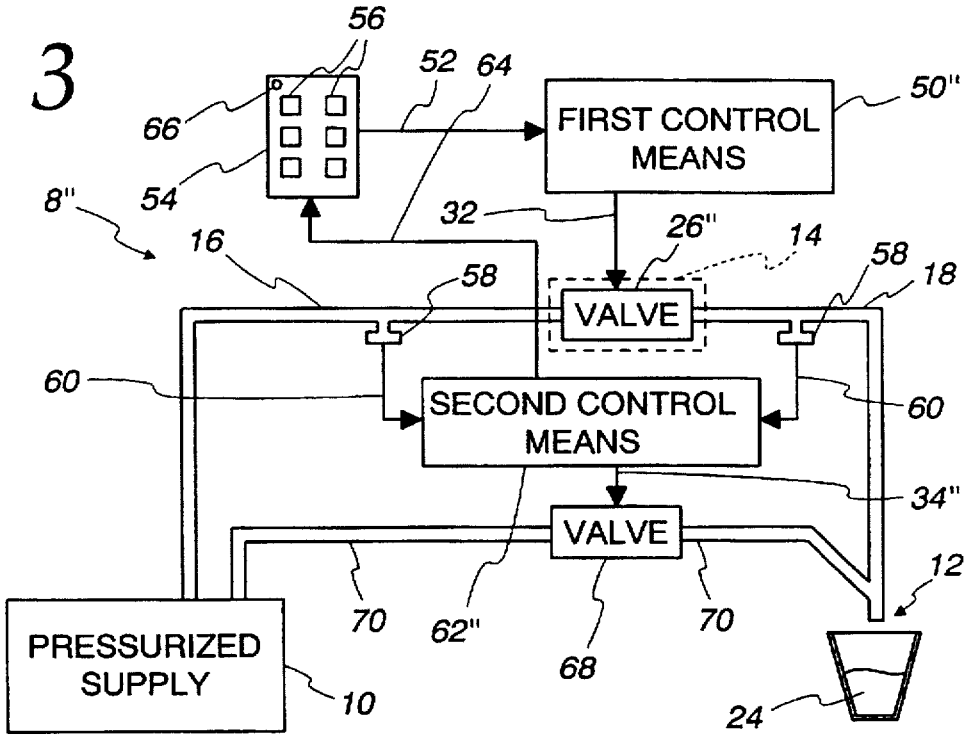
FIG. 3 is a schematic representation of a third embodiment of a liquid dispensing device according to the present invention.

With reference to FIG. 3, wherein like elements of FIG. 1 are designated with the same reference numbers and elements which have been modified are designated with a double prime ("), an alternative embodiment of the regulating/dispensing apparatus/system 8" is provided. This embodiment operates similarly to the apparatus/system depicted in FIG. 1, except that a second valve 68 is provided in a compensation line 70. The second valve 68 may be provided in the dispenser 14, or may be separate as shown in FIG. 3. In this embodiment, the compensating delivery of beverage occurs independent of valve 26", which is only responsive to the first control signal 32, and accordingly is held in an open position for a predetermined set time interval dependent upon the size of the container 24 to be filled. The second control means 62" receives the pressure signal 60 from the pressure sensor 58, and in response thereto produces the second control signal 34" which is supplied to the second valve 68. In a preferred form, the second valve 68 is similar in construction to the valve 26 and operates similarly thereto.

The second control signal 34" causes the second valve 68 to be placed in an open position for a predetermined time interval to allow a compensating delivery of beverage to flow from the supply 10 through the compensation line 70 to the container 24 to help ensure that the selected volume of beverage is delivered to the container 24 regardless of a change in the pressure of the beverage supply line (first and second lines, 16, 18). However, a drawback is that since the valve 26" cannot be shut off early, there is no overflow control.

With respect to FIG. 4, wherein like elements of FIG. 3 are designated with the same reference numbers and elements which have been modified are designated with a triple prime ("'), an alternative embodiment of the regulating/dispensing apparatus/system 8"' is provided. In this embodiment, the first control means 50"' is adapted to receive the pressure signal 60 from the pressure sensor 58 and produces the second control signal 34", which is supplied to the second valve 68. The second control signal 34" causes the second valve 68 to operate in a manner similarly to that previously described with respect to FIG. 3, with the same advantages and drawbacks. Accordingly, a compensating delivery of beverage from the supply 10 to the container 24 is provided independent of the operation of the valve 26".

The foregoing description was made for purposes of demonstrating the basic operation of the present invention, and no unnecessary limitations are to be understood therefrom.

I claim:

1. An apparatus for controllably delivering a liquid under pressure from a supply to a first location, the apparatus comprising:

first means operable for a predetermined first time interval to cause flow of a first predetermined quantity of liquid at a first pressure from the supply to the first location; and second means for sensing the pressure of the liquid and as an incident of sensing that the pressure of the liquid is not at the first pressure causing a compensating delivery of liquid from the supply to the first location so that the first predetermined quantity of liquid is delivered to the first location each time the first means is operated for the first time interval, wherein said first means comprises:

a dispenser having a valve changeable between (a) a first state wherein liquid is allowed to flow from the supply to the first location and (b) a second state;

means responsive to a first signal for changing the valve from the second state into the first state;

first control means for producing the first signal in response to a user inputted command; and user operable means for entering the command.

2. The apparatus of claim 1, wherein the second means includes means for producing a second signal indicative of the fact that the pressure of the liquid sensed by the second means is one of (a) greater than and (b) less than the first pressure, the valve having means responsive to the second signal for controlling the state of the valve so that the first predetermined quantity of liquid is delivered to the first location each time the command is entered by the user.

3. The apparatus of claim 1, wherein the second means includes means for producing a third signal indicative of the fact that the pressure of the liquid sensed by the second means has fallen below a preset value, the user operable input means having means responsive to the third signal to provide an indication thereof to a user.

4. The apparatus of claim 2, wherein (A) with the pressure of the liquid sensed by the second means less than the first pressure, the valve controlling means causes the valve to be placed in the first state for a period of time longer than the first time interval by at least one of (a) maintaining the valve in the first state for an extra predetermined time interval and (b) switching the valve from the second state back to the first state for an extra predetermined time interval after the expiration of the first time interval, and (B) with the pressure of the liquid sensed by the second means greater than the first pressure, the valve controlling means causes the valve to be placed in the first state for a period of time shorter than the first time interval by switching the valve to the second state before the expiration of the first time interval.

5. The apparatus of claim 4, in combination with a pressurized supply of liquid.

6. The apparatus of claim 2, wherein the dispenser includes:

an inlet port in fluid communication with the supply via a first line;

an outlet port in fluid communication with the first location via a second line; and a flexible tube member connecting the inlet and outlet ports.

7. The apparatus of claim 6, wherein the second means includes a pressure sensor operatively connected to at least one of (a) the first line and (b) the second line, and wherein the second signal producing means includes a second control means for receiving a pressure signal generated by the pressure sensor and producing the second signal in response thereto.

8. The apparatus of claim 6, wherein the valve comprises a solenoid valve.

9. The apparatus of claim 8, wherein with the valve in the first state liquid is allowed to flow from the supply to the first location through the flexible tube member, and with the valve in the second state the valve compresses the flexible tube member so that liquid is prevented from flowing from the supply to the first location through the flexible tube member.

10. The apparatus of claim 9, wherein the solenoid valve includes:

an electrically operated solenoid having energized and deenergized states which the solenoid assumes in response to the first and second signals;

an armature extending from the solenoid; and a closure member attached to the armature, wherein the solenoid in the deenergized state forces the closure member against the flexible tube member to prevent the flow of liquid therethrough, and wherein with the solenoid in the energized state the closure member is repositioned relative to the flexible tube member to allow the flow of liquid therethrough.

11. In an apparatus for selectively delivering a plurality of predetermined different quantities of liquid from a supply to a first location through a supply line, the apparatus including first means selectively operable for a plurality of predetermined different time intervals to cause flow of the plurality of predetermined different quantities of liquid from the supply to the first location with the liquid supply at a first pressure, wherein during one predetermined time interval one predetermined quantity of liquid is allowed to flow from the supply to the first location with the liquid at the first pressure, the first means including a dispenser operably connected to the supply line and having a valve changeable between (a) a first state wherein liquid is allowed to flow from the supply to the first location and (b) a second state, means responsive to a first signal for changing the valve from the second state to the first state, first control means for producing the first signal in response to user inputted commands, and user operable means for entering the commands, the improvement comprising:

second means for sensing the pressure of the liquid and as an incident of sensing that the pressure of the liquid is not at the first pressure causing a compensating delivery of liquid form the supply to the first location so that said one predetermined quantity of liquid is delivered to the first location each time the first means is operated for said one predetermined time interval.

12. The improved apparatus for delivering liquid of claim 11, wherein the second means includes means for producing a second signal indicative of the fact that the pressure of the liquid sensed by the second means is one of (a) greater than and (b) less than the first pressure, the valve having means responsive to the second signal for controlling the state of the valve so that said one predetermined quantity of liquid is delivered to the first location each time said one predetermined quantity of liquid is selected by the user.

13. The improved apparatus for delivering liquid of claim 12, wherein (A) with the pressure of the liquid sensed by the second means less than the first pressure, the valve controlling means causes the valve to be placed in the first state for a period of time longer than said one predetermined time interval by at least one of (a) maintaining the valve in the first state for an extra predetermined time interval and (b) switching the valve from the second state back to the first state for an extra predetermined time interval after the expiration of said one predetermined time interval, and (b) with the pressure of the liquid sensed by the second means greater than the first pressure, the valve controlling means causes the valve to be placed in the first state for a period of time shorter than said one predetermined time interval by switching the valve to the second state before the expiration of said one predetermined time interval.

14. The improved apparatus for delivering liquid of claim 13, in combination with a pressurized supply of liquid.

15. The improved apparatus for delivering liquid of claim 12, wherein the supply line includes a first supply line connecting the supply to an inlet port of the dispenser, and a second supply line connecting an outlet port of the dispenser to the first location, and wherein the dispenser further includes a flexible tube member connecting the inlet and outlet ports.

16. The improved apparatus for delivering liquid of claim 15, wherein the second means includes a pressure sensor operatively connected to at least one of (a) the first supply line and (b) the second supply line, and wherein the second signal producing means includes a second control means for receiving a pressure signal generated by the pressure sensor and producing the second signal in response thereto.

17. The improved apparatus for delivering liquid of claim 16, wherein the valve comprises a solenoid valve.

18. The improved apparatus for delivering liquid of claim 17, wherein the solenoid valve includes:

an electrically operated solenoid having energized and deenergized states which the solenoid assumes in response to the first and second signals;

an armature extending from the solenoid; and a closure member attached to the armature, wherein the solenoid in the deenergized state forces the closure member against the flexible tube member to prevent the flow of liquid therethrough, and wherein with the solenoid in the energized state the closure member is repositioned relative to the flexible tube member to allow the flow of liquid therethrough.

19. The improved apparatus for delivering liquid of claim 18, wherein the solenoid valve includes a compression spring which forces the closure member against the flexible tube member with the solenoid in the deenergized state to prevent the flow of liquid therethrough.

20. The improved apparatus for delivering liquid of claim 11, wherein the user operable means includes a control panel having a plurality of push button switches for selecting which of said plurality of predetermined different quantities of liquid is to be delivered to the first location.

21. The improved apparatus for delivering liquid of claim 11, wherein the second means includes means for producing a tank empty signal indicative of the fact that the pressure of the liquid sensed by the second means has fallen below a preset value, the first means having means responsive to the tank empty signal to provide an indication thereof to a user.

* * * * *